United States Patent [19]

Gordon

[11] Patent Number: 4,569,515

[45] Date of Patent: Feb. 11, 1986

[54] EXERCISE STRUCTURE AND BALL GAME

[76] Inventor: Donald W. Gordon, 6061 Candlelight, Yorba Linda, Calif. 92806

[21] Appl. No.: 435,081

[22] Filed: Oct. 18, 1982

Related U.S. Application Data

[63] Continuation-in-part of Ser. No. 39,347, May 16, 1979, Pat. No. 4,433,838.

[51] Int. Cl.[4] ..... A63B 5/00

[52] U.S. Cl. ..... 272/65; 273/401; 273/411

[58] Field of Search ..... 272/61, 65, 56.5 R, 272/2, 3; 273/401, 411, 26 A, 181 F; 135/97, 119

[56] References Cited

U.S. PATENT DOCUMENTS

| | | | |
|---|---|---|---|
| 1,556,046 | 10/1925 | Taylor | 273/411 |
| 3,201,126 | 8/1965 | Nissen . | |
| 3,222,067 | 10/1965 | Litwhiler et al. | 135/97 |
| 3,233,895 | 2/1966 | Grelle et al. | 272/65 |
| 3,312,471 | 4/1967 | Nissen | 273/411 |
| 3,356,366 | 12/1967 | Barthel . | |
| 3,501,141 | 3/1970 | Nissen | 272/65 |
| 4,139,192 | 2/1979 | McNeil | 272/65 |
| 4,433,838 | 2/1984 | Gordon | 272/65 |

FOREIGN PATENT DOCUMENTS

| | | | |
|---|---|---|---|
| 847746 | 10/1939 | France | 273/411 |
| 716558 | 2/1980 | U.S.S.R. | 272/56.5 R |

OTHER PUBLICATIONS

Gordon's HiBall brochure, 1979.

*Primary Examiner*—Richard J. Apley
*Assistant Examiner*—S. R. Crow
*Attorney, Agent, or Firm*—Knobbe, Martens, Olson & Bear

[57] ABSTRACT

A structure for use as an exercise compartment and a method for playing a ball game therein is disclosed. The structure has a horizontal rebound surface which is supported above the ground and has means for enclosing the air space above said surface to form a cell, said cell being of a size suitable for enclosing at least one human using said surface as a springboard for exercise or for playing the ball game.

5 Claims, 23 Drawing Figures

Fig. 21
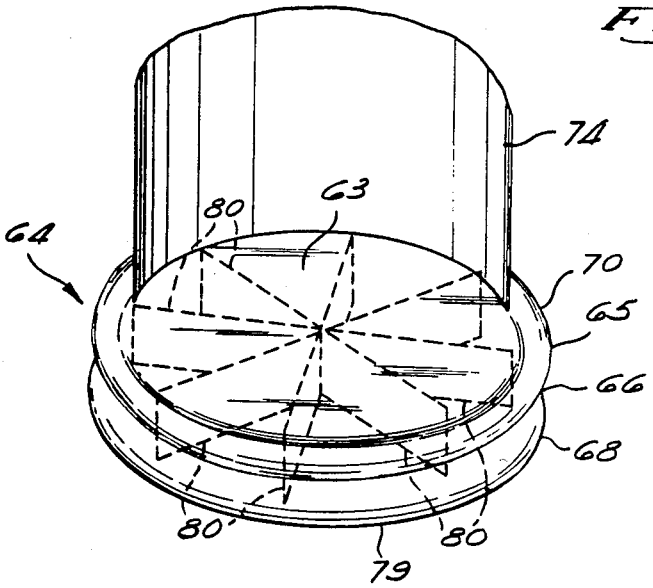
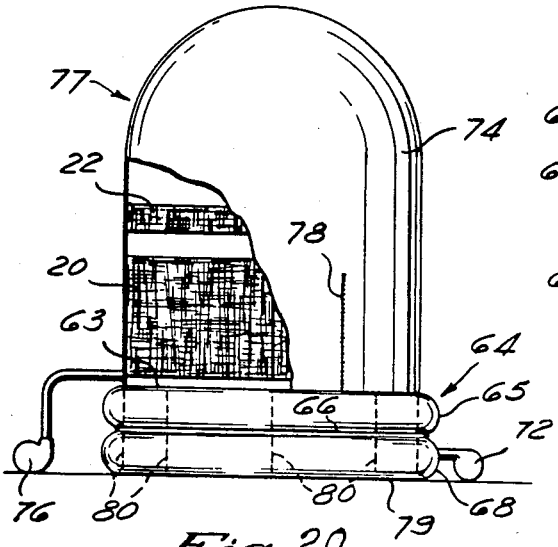
Fig. 20
Fig. 22
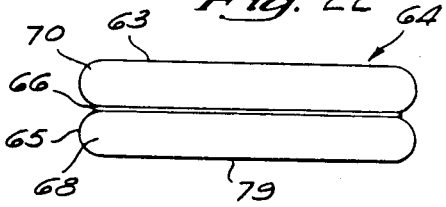
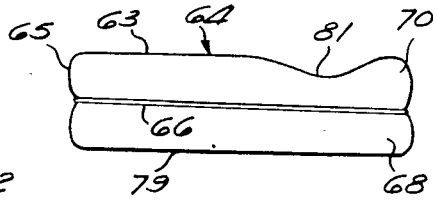
Fig. 23

EXERCISE STRUCTURE AND BALL GAME

This application is a continuation-in-part application of prior copending application, Ser. No. 039,347, filed on May 16, 1979, now U.S. Pat. No. 4,433,838.

BACKGROUND OF THE INVENTION

This invention is related to exercise devices and games associated therewith.

The trampoline is well known as an exercise device. Traditionally, a trampoline is formed from a sheet of material such as canvas which forms the trampoline bed and which is attached to a rigid support frame by elongate elastic means such as springs. The sheet of material is therefore resiliently supported above the ground in a horizontal position, and functions as a springboard for the user. In using the trampoline, one jumps up and down on the bed and, with practice, can perform acrobatic feats in mid-air above the bed.

An important parameter of trampolines which allows one to perform such gymnastics will be designated "rebound factor" for the purposes of this specification. Rebound factor as herein defined is a percentage of the distance an object will be rebounded after falling onto the bed from said distance. Rebound factor therefore is a function of the weight of the object as well as the spring of the bed. Typically, a trampoline will have a rebound factor of about 50% for an average human being. Thus, if an average adult were to fall 10 feet onto a trampoline, he wound be rebounded about five feet into the air.

Although the trampoline offers great enjoyment and exercise for the user, it also poses significant dangers.

Many injuries have resulted in using a trampoline from the user falling from the bed onto the ground below or falling onto hard objects such as the support frame or springs. Also, due to the construction of the trampoline, it is quite easy for the user's arm or leg to slip between the support frame and the bed which can cause severe injury.

Games have been created for play on a trampoline. One of these games involves a volleyball-type net which is suspended above the trampoline bed. The game is then played in a volleyball-type fashion, upon the trampoline with two or more players hitting or throwing the ball above the net. A variation of this game as generally described in U.S. Pat. Nos. 3,201,126, 3,256,021, and 3,312,471, is to have the net extend down to the bed and to have a hole in the net, with the object being to throw the ball through the hole in the net rather than above the net.

These games, although offering fun and exercise, possess all of the serious injury potential of the trampoline alone. In fact, the dangers are probably greater in that the players can easily become more concerned with the competitiveness of the game rather than their proximity to the edge of the trampoline bed.

Also known in the art is a device which consists of an inflated pneumatic cushion, the upper side of which is enclosed by an inflated structure which serves as the walls and roof. The device is particularly designed for children who enjoy walking about the soft cushion. This device offers an advantage over trampoline games in that there are no rigid supports which can cause injury. However, it suffers the disadvantage in that the rebound factor of the cushion is much less than that of a trampoline bed, being only about 10% for an average adult.

The disclosed invention is a significant improvement over past devices in that it offers the safety of the pneumatic cushion devices while offering the rebound factor of the trampoline.

SUMMARY OF THE INVENTION

The disclosed invention is a structure in which one or more persons can exercise. The invention also includes a method for playing a ball game within the exercise structure. The structure includes a rebound surface, such as a trampoline bed, which acts as a springboard for the user and is supported above the ground. The rebound surface has a rebound factor of at least 20%, preferably at least 30% and optimally at least 50%. The air space above the surface is enclosed to form a cell of a sufficient size to permit at least one person to exercise within the cell.

The bouncing form of exercise, as on a trampoline, is well known as one of the most beneficial of exercises. This is due to the fact that, in jumping up and down on the resilient rebound surface, gravitational forces are exerted upon the body of the user, putting resistance on virtually every cell and each cell resists the pull of the gravitational or "G" forces similar to large muscle groups resisting weights. The pulse rate is increased as rapidly as when running, and the lungs and cardiovascular system are developed. In addition, the exercise is excellent for reducing and strengthening the stomach and waist as well as developing whole body coordination and timing and developing aerial balance and equilibrium. This form of exercise affects all portions of the body equally and does not put excessive stress upon the joints. Thus, there is no tendency to produce inflamation within the joints, or bursitis, such as is commonly incurred in a sport such as tennis, and which is referred to as "tennis elbow".

This highly beneficial exercise can be obtained without the dangers normally encountered in the standard trampoline. This is due to the special construction of the disclosed inventive structure. Specifically, the structure has means for enclosing the air space above the rebound surface, which forms a cell within which the user can exercise. The cell is of the size suitable to enclose at least one person and preferably at least four persons. The enclosing means is attached at or within the outer perimeter of the rebound surface or bed, thus making it virtually impossible for the user to fall off of the surface or encounter any foreign hard obstacles which could cause injury. In short, one can enjoy all of the benefits of the exercise with a minimal risk of any injury.

The device also allows multiple users to exercise within the structure at the same time without fear of injury. Strong perpendicular restraining nets which divide the cell into quadrants allow as many as four persons to use the surface at a time. A person in such a quadrant may safely exercise due to these restraining nets which prevent the users from injuring each other by entering another's quadrant. Additional restraining nets could be added, to accomodate greater than four players, if desired.

A second embodiment of the exercise structure provides individual rebound surfaces for each exercise quadrant. Providing individual rebound surfaces more completely isolates the exercise quadrants and results in added safety to the players.

Another aspect of the invention involves a ball game which is played within the exercise structure. The perpendicular restraining nets are again stretched across the cell, dividing the cell into four quadrants. Each player has his own quadrant. Two perpendicular game nets are also stretched across the cell above the restraining nets and in generally the same planes. A bouncing volleyball-like game is then played in which a ball is hit or thrown above the game nets.

Optionally, a single exercise structure can provide for four players to cooperate and play one game, or can allow four players to split and play two independent games. The game incorporates the essential elements of volleyball, rebounding in basketball, racquetball, tennis, ping-pong, and water polo.

Since the rebound surface has a large rebound factor, the disclosed invention offers all of the exercise, excitement, and enjoyment of a trampoline. However, due to the fact that the air space of the rebound surface is enclosed within a protective cell, thereby avoiding the danger of a person falling off the surface or hitting a rigid support member, and the fact that restraining nets prevent multiple players from injuring one another, the disclosed invention virtually eliminates the disadvantages of prior trampoline devices. A further advantage of the structure is its ease in manufacture which allows the structure to be constructed at a much lower cost than that required for installing racquetball or tennis courts.

DESCRIPTION OF THE DRAWINGS

These and other features of the present invention are best understood through the following detailed description of the preferred embodiments which reference the drawings, in which:

FIG. 20 is a perspective view, partially in section, of an alternative embodiment of the invention;

FIG. 21 is an enlarged view of the lower portion of the alternative embodiment shown in FIG. 20, with the upper cell structure partially cut away;

FIG. 22 is a schematic illustration of the rebound surface at equilibrium of the alternative embodiment of FIGS. 26 and 21; and FIG. 23 is a schematic illustration showing the effect of depressing the rebound surface of the alternative embodiment of FIGS. 20 and 21.

DETAILED DESCRIPTION OF THE PREFERRED EMBODIMENT

Figure 1:
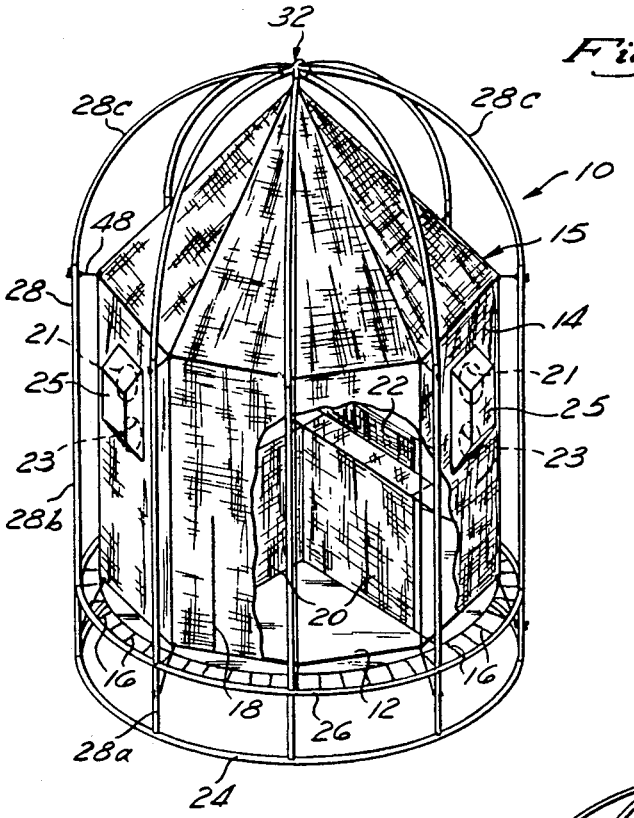
FIG. 1 is a perspective view, partially cut away, of a first preferred embodiment of the entire exercise structure.

Referring first to FIG. 1, a first preferred embodiment of the invention is shown to comprise a structural metal frame system 10 which supports a flexible rebound surface 12 which, in the first preferred embodiment, is round and 13 feet, 6 inches in diameter. The rebound surface has a rebound factor of at least 20%, preferably at least 30% and optimally at least 50%. The air space above the rebound surface 12 and within the metal framework 10 is enclosed by a fabric skirt 14 which forms the exercise cell generally shown at 15. The fabric used to form skirt 14 is preferably breather material, that is, an open-weave netting through which air easily passes. The rebound surface 12 is attached to the framework 10 by means of a plurality of springs 16 in the manner commonly used in constructing trampolines. One can enter the interior of the cell 15 through an opening such as that created by a zipper 18. Within the cell 15 are shown two mutually perpendicular restraining nets 20 and above them, two smaller mutually perpendicular game nets 22. As part of a ball game described later, a first aperture 21 and a second aperture 23 are shown through the fabric of cell 15. A fabric ramp 25 is attached to the exterior of cell 15 over the apertures 21 and 23.

Figure 2:
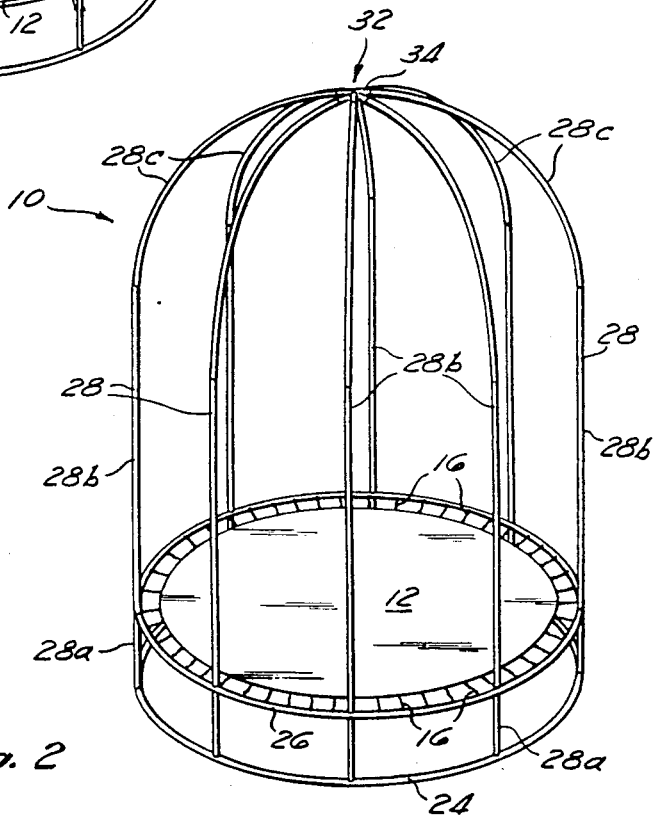
FIG. 2 is a perspective view of the supporting frame and rebound surface of the exercise structure of FIG. 1, with the fabric (from other than the rebound surface) and cable sections removed.

Referring now to FIG. 2, the frame structure 10 generally comprises a lower, rigid circular support frame 24, an upper, rigid circular support frame 26, and eight vertical support members 28 which connect the upper and lower support frames 24, 26, and which extend above the upper support frame 26, curving to meet at an apex shown generally as 32. In the first preferred embodiment, the lower support frame 24 is generally circular in shape and lays horizontally on the ground. A preferred diameter of the lower support frame is approximately 14 feet. The upper support frame 26 is above and generally parallel to the lower support frame 24, is generally in the plane of the rebound surface 12, and directly supports said surface 12 above the ground. It also is preferably circular and approximately 14 feet in diameter.

There are preferably eight separate vertical support members 28 arranged at regular (45°) intervals about the upper and lower support frames 24,26, and which rise vertically to meet at the apex 32.

The upper support frame 26 is approximately three feet above the lower support frame 24, and the structure 10 itself measures about 20 feet from the ground to the apex 32.

Figure 3:
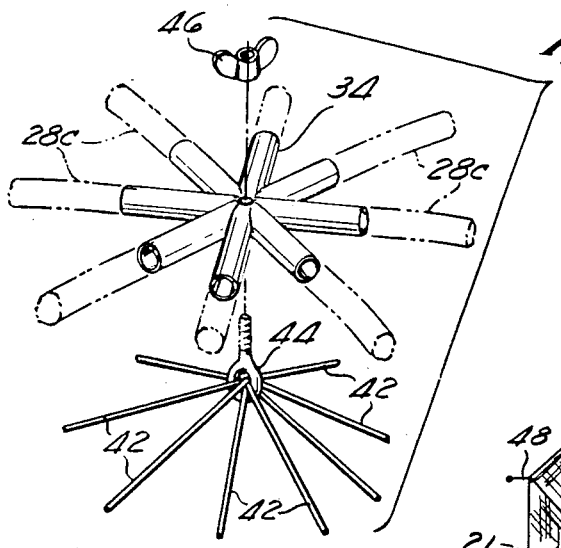
FIG. 3 is an enlarged and exploded view of the device used to connect the apex of the said exercise structure.

The support structure 10 is made from sections of lightweight metal piping such as aluminum or aluminum alloy. The sections of the piping are joined together through male-female joints (not shown). Thus, the lower and upper support frames 24 and 26 are composed of four sections of piping of generally equal arc length (90°). Each includes an extending, axially centered pin at one end, and an axially centered bore or pocket at the other end sized to tightly receive the pin of the next adjacent section. The vertical support member 28 is composed of three sections of piping. The first section 28*a* connects the lower and upper support frames 24,26, the second section 28*b* rises vertically to the point of curvature of the vertical support member 28, and the third section 28*c* of piping is curved so as to allow the vertical support members 28 to meet at the apex 32. The eight vertical support members 28 to meet at the apex through a spider joint 34, which is best shown in an enlarged view in FIG. 3. The joint 34 is engaged with the third section 28*c* using a male-female joint as previously described. The section 28*c* is advantageously identical to the 90° sections of the support frames 24 and 26 to reduce manufacturing costs.

Figure 4:
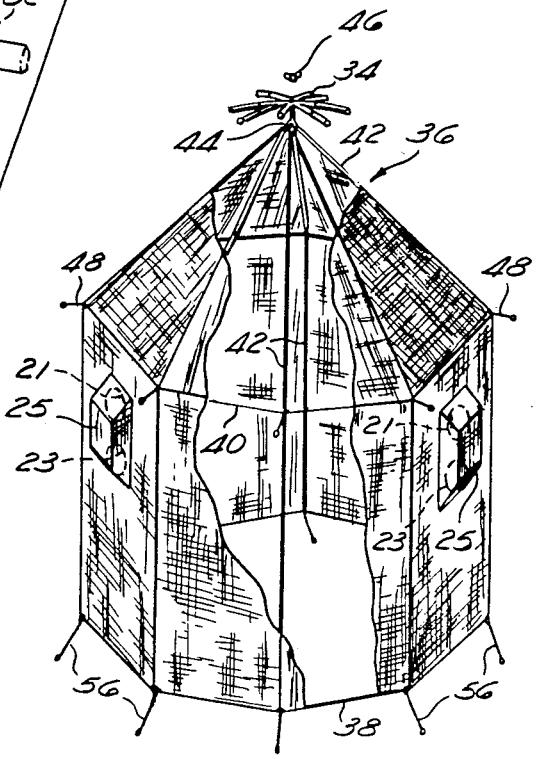
FIG. 4 is a perspective view of the cable structure of the cell of FIG. 1, with the supporting frame of FIG. 2, springs and rebound surface removed.

Reference is now made to FIG. 4, in which the cable system is shown generally as 36. The skirt 14 is located between the cable system 36 and the framework structure 10. The cable system 36 thereby functions to affix the skirting 14 to the framework structure 10, as will be discussed in detail below with respect to FIG. 5. The cable system 36 comprises a lower octagonal cable 38, an upper octagonal cable 40; and eight vertical cables 42 are shown connected through the opening in an eye bolt 44. In this exploded view, the shank of the eye bolt 44 is shown as passing through the center of the spider joint 34. The eye bolt 44 is then tightened through the use of a wing nut 46, as is apparent to those of ordinary skill in the art.

The cable in the cable system 36 can be made from a strong rope or a metal cord covered with a plastic material, as is well known to those of ordinary skill in the art.

The lower and upper octagons formed by octagonal cables 38,40 have cross-sectional maximum widths of approximately 13 feet, 6 inches, that is, slightly less than or equal to the diameter of the rebound surface 12. The distance between the upper and lower octagonal cables 38,40 is approximately 11 feet, 3 inches, and the distance from the upper octagonal cable 40 to the eye bolt 44 is approximately 5 feet, 6 inches.

Figure 5:
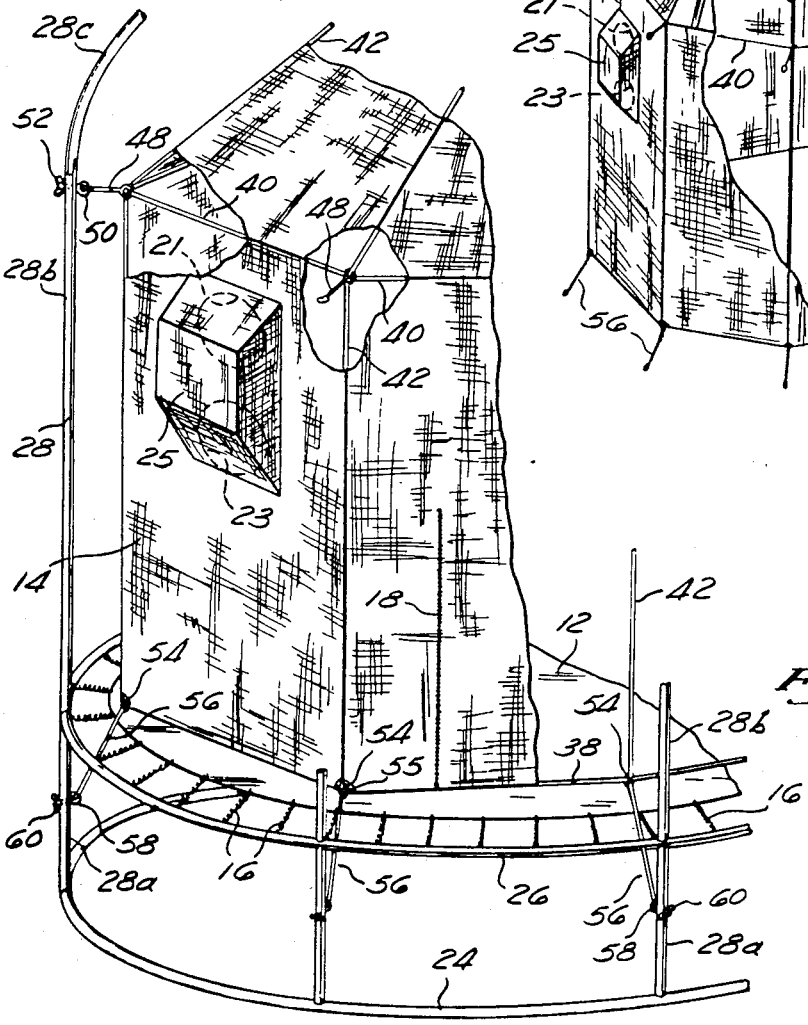
FIG. 5 is a partial perspective view of the lower portion of the exercise structure partially cut away to show the details of fabric, frame, and cable interconnections.

Referring now to FIG. 5, the remainder of the anchoring of the cable system 36 and skirt 14 to the framework 10 will be described. The upper octagonal cable 40 is attached to each of the vertical support members 28 by a fastening cable 48, which in turn is attached to an eye bolt 50 that is threaded through a hole in the vertical support member 28 and is tightened with the use of a wing nut 52. A hem (not shown) is formed at the bottom edge of the skirt 14, and the lower octagonal cable 38 is threaded through this hem. Each of the eight vertical cables 42 is tied to the lower octagonal cable 38 at this hem, an located at the outer perimeter of the rebound surface 12, generally shown at point 54. At points 55, in close proximity to each of the points 54, the lower octagonal cable 38 is attached to anchoring cables 56 which are in turn attached to a portion of the vertical support member 28 approximately half-way along section 28*a*. The anchoring cables 56 are connected to the vertical support section 28*a* through the use of an eye bolt 58 and wing nut 60 as is well known to those of ordinary skill in the art. Because of the diagonal direction of cables 56, they pull the octagonal cable 38 and vertical cables 42 downward and outward, forming a relatively unyielding cable system 36 for forming the cell 15. In addition, the tightening of the cable system 36 with wing nuts, as described, holds the framework 10, with its male-female joints, together.

The result of this fastening arrangment is that the skirt 14 is accurately positioned adjacent the perimeter of the rebounding surface 12, without actually being fastened to the outer perimeter of the rebound surface 12. Therefore, the skirt 14 at the interface of the rebound surface 12 takes on a generally octagonal shape in conformance to the lower octagonal cable 38. Advantageously, the skirt 14 is as close to the outer perimeter of the rebound surface 12 as possible. The exercise cell 15 is formed completely at or within the rebound surface 12; and therefore, a person within exercise cell 15 of the invention cannot fall from the rebound surface 12 or encounter hard obstacles, such as the springs 16 or the support frame 10. In addition, it is not possible for one inside the exercise structure to accidentally have an arm or leg slip through the space between the upper support frame 26 and the rebound surface 12. Because the vertical skirt 14 is held taut by the cable system 36, a person falling against the skirt 14 will slide thereon onto the rebound surface 12 without injury.

Figure 6:
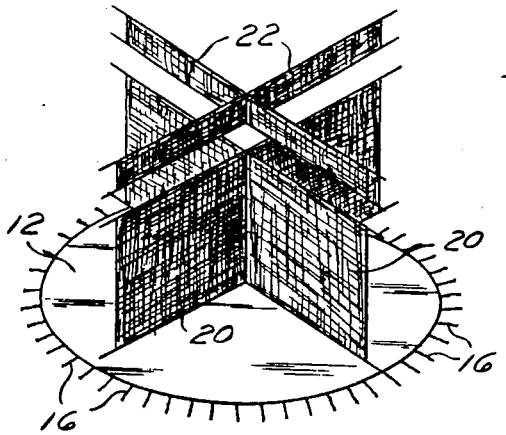
FIG. 6 is a cutaway view of the restraining and game nets, rebound surface, and springs inside the exercise structure of FIG. 1.

FIG. 6 is a cutaway drawing of the interior of the exercise cell 15 showing the restraining nets 20 and the game nets 22. The restraining nets 20 lie generally in mutually perpendicular vertical planes and divide the exercise cell 15 into quadrants. The restraining nets 20, which are preferably made of strong nylon breather material, serve to prevent users from injuring each other while playing or exercising. Thus, at least four persons (one for each quadrant) can exercise or play at the same time without risking injury. If desired, single or multiple nets 20, depending upon the size of exercise area desired, can be employed. The nets 20 are taut and thus deflect players as previously described in reference to skirt 14.

Above the restraining nets 20 and in generally the same planes, are two perpendicular game nets 22. Their function will be more fully described below in reference to a game played within the cell 15. The restraining nets 20 are 7 feet in height, and the game nets 22 are 18 inches high, and generally 10 feet above the rebound surface 12.

Figure 7:
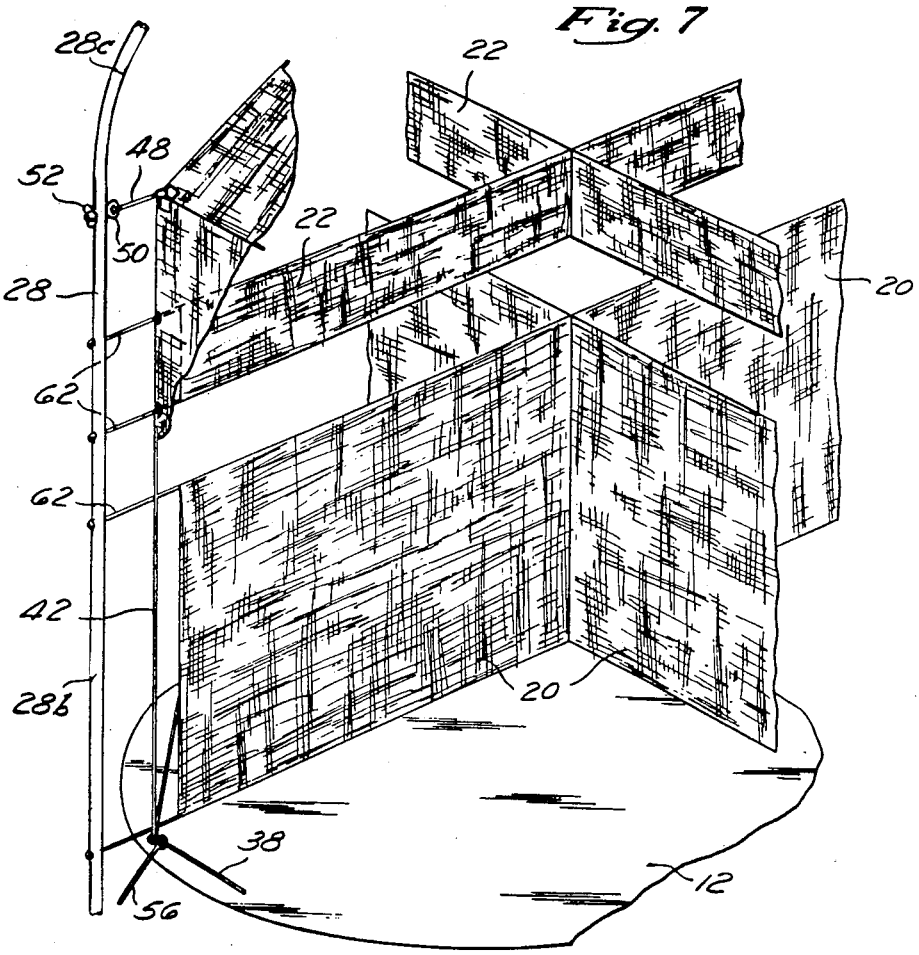
FIG. 7 is an enlarged cutaway view of the restraining and game nets of FIG. 6 within the exercise structure, and also show their means of attachment to the supporting frame of FIG. 2.

Referring now to FIG. 7, the restraining and game nets 20,22 are each attached to an opposing pair of vertical support members 28 by means of plural short ropes 62. The precise nature of the attachment is not of critical importance to the invention and could be accomplished in other ways well known to those of ordinary skill in the art, so long as the nets 20 remain relatively taut. The nets 20 and 22 are thus attached to four different vertical support means 28.

The exercise cell 15 which has been described, is not only suitable for exercise, but also for the inventive ball game which will now be described.

The ball game can be played one-against-one, i.e., singles, two-against-two, i.e., doubles, and also by three or four individuals each playing for themselves. The game will be described in terms of singles and doubles. However, obvious variations will be apparent from these descriptions.

A 14-inch diameter, light game ball, similar to a volleyball, is used. It is also possible to use a special 6-pound medicine ball for exercising and timing only. The object of the game is to hit or pass a ball back and forth over the game nets 22 without permitting it to touch the rebound surface 12. The players attempt to place the ball into the opposing court in a position which makes it difficult for the opponents to return it.

All players stand still anywhere in their quadrants to begin the game, whether it be singles or doubles. The server may stand any place in his quadrant that he chooses. He may serve with no bounce, or he may serve with one bounce, that is, he may bounce into the air from a dead stand as long as the ball leaves his hand before he again contacts the rebound surface 12. All other players may begin motion only after the ball leaves the server's hand. If the server does not clear the net 22 and the ball falls back into his court, it is called a miss, and the other side scores one point. It is permissible on service and during play for the ball to hit the skirt 14 surrounding the rebound surface 12.

A player may not at any time touch the game net 22 or any portion of the restraining net 20 below it. If he does so, his opponent gains a point. When spiking the ball at the apex of his bounce, a player's hands may not go beyond the vertical plane of the game net 22.

In singles play, each player occupies one quadrant of space. The game is preferably played parallel rather than diagonally. Of course, the game could be played by each player using one-half of the full playing area by removing one playing net 22 and restraining net 20. However, the game is best played with a limited amount of horizontal space. In singles, scoring only occurs as described above with respect to the service and when one player allows the ball to strike the rebound surface 12 or he is unable to return it within one bounce of his body against the rebound surface. If a player catches the ball while his feet are in contact with the rebound surface, he may go into the air and contact the rebound surface once. Then he must release the ball. If the rebound surface is contacted twice from an aerial position, it is considered a miss, and the opposing player gains one point.

In doubles play, the area of play consists of all four quadrants, each player occupying one quadrant. The game is played both diagonally and in parallel. With respect to serving, Server No. 1 of Team A is allowed two serves after which the ball goes to Server No. 1 of Team B. After two serves, the ball goes to Server No. 2 of Team A who serves twice and then relinquishes the ball to Server No. 2 of Team B. The cycle is then repeated until there is a winner. Either side may score whether they are server or receiver. Scoring only occurs from a miss in serving, i.e., two fouls, and when a player allows the ball to strike the rebound surface 12 or he is unable to return it within two bounces of his or his team mate's body against the rebound surface 12. Each team therefore has two bounces to return the ball. The bounces can be taken by one team member or the ball may be passed to the team mate and split between the two players. If a player catches a ball while his feet are in contact with the rebound surface, he may go into the air and he or his team mate may contact the rebound surface two more times before passing the ball. If the rebound surface is contacted three times from an aerial position, it is considered a miss and the opposing team gains a point.

Another aspect of a ball game which can be played by one or more players and is best shown in FIG. 5 involves attempting to throw a ball through a first aperture 21 in the skirt 14. If a player is successful in the toss, the ball is guided by a ramp 25 to a second aperture 23 located below the first aperture 21. The ball then passes through the second aperture 23 and is returned to the cell 15. The ramp 25 can be made from the same type of breather fabric material as is the skirt 14 and may be attached to the skirt 14 by sewing or any other convenient method which is apparent to those of ordinary skill.

Figure 8:
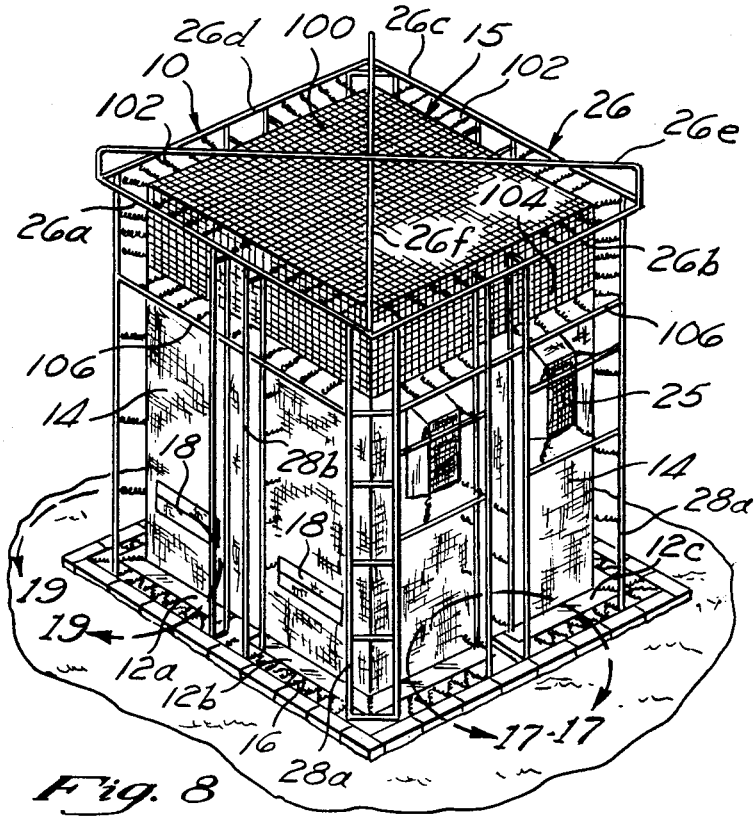
FIG. 8 is a perspective view of a second preferred embodiment of the entire exercise structure.
Figure 9:
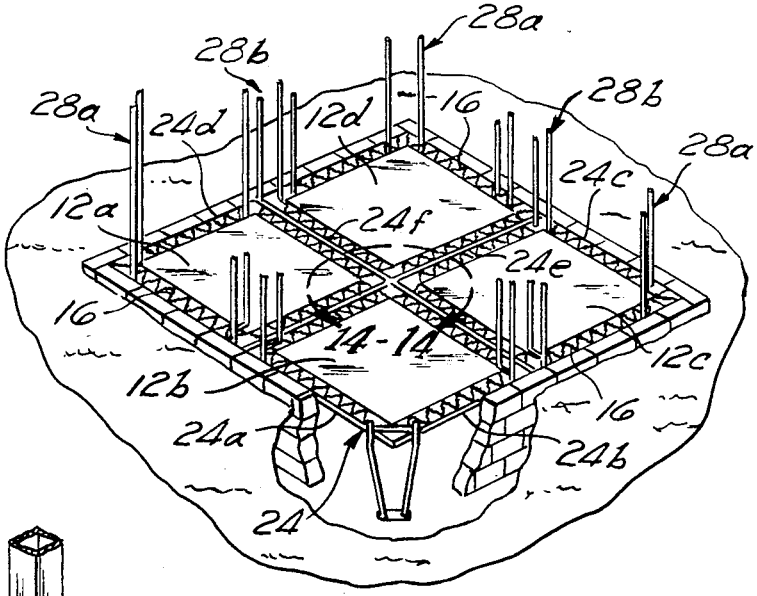
FIG. 9 is a perspective view of a portion of the supporting frame and individual rebound surfaces of the exercise structure of FIG. 8, with the fabric (from other than the rebound surfaces) removed.

Referring now to FIG. 8 and FIG. 9, a second preferred embodiment of the exercise structure is shown having its elements correspondingly numbered in relation to similarly functioning elements of the above-described first preferred embodiment.

A rectangular metal frame system is generally referenced by the numeral 10, and supports individual flexible rebound surfaces 12*a*, 12*b*, 12*c* and 12*d* (hereinafter referenced collectively as "rebound surfaces 12"). The rebound surfaces 12 have a rebound factor of at least 20%, preferably at least 30%, and optionally at least 50%. The rebound factor can be adjusted, and is determined in part by the number of springs 16 utilized to couple the rebound surfaces 12 to the support system 10, as described in detail in reference to FIG. 12 and FIG. 14. The air space above the rebound surfaces 12, and within the frame system 10, is enclosed by fabric restraining walls 14. The restraining walls 14 form and define the rectangular exercise cell generally referenced by the numeral 15. The fabric utilized to form the restraining walls 14 is preferably a breather material such as that described above in reference to FIG. 1. A player enters the cell 15 through horizontal reinforced openings 18.

There are a number of problems inherent in providing a generally rectangular exercise structure such as the embodiment of FIG. 8. Most importantly, there must be included means for preventing substantial flexing of a horizontal length of the restraining walls 14. In the generally octagonal exercise structure of FIG. 1, the restraining walls 20 are not of substantial horizontal length and are supported by the cable system 36. Thus, there is not inherent in the octagonal structure a large degree of flexing along the horizontal length of the restraining walls 14. In comparison, the restraining walls 14 of the rectangular structure are of substantial horizontal length and must provide effective restraining of the players over the side length of the walls 14. Thus, the center, or middle, of the restraining wall 14 must be prevented from flexing so far as to not effectively deflect a player. The means for performing this function is described in detail below.

Figure 13:
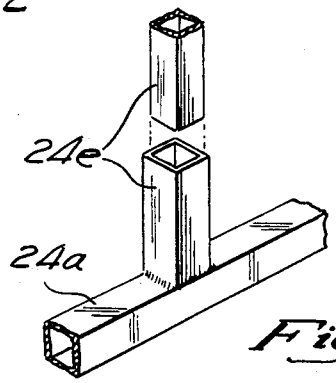
FIG. 13 is an enlarged view of means for interconnecting various segments of the supporting frame of the structure of FIG. 8.

The frame structure 10 generally comprises a lower, rigid rectangular support frame 24, an upper rigid rectangular support frame 26, eight vertical support groups 28 which couple together the lower 24 and upper 26 support frames, and 10 support members 27 which support the frame 24 in a horizontal plane a set distance above the ground. The various lengths of the support frame 10 can be fabricated of male-female joints as shown in FIG. 13.

As shown in FIG. 8, the exercise cell 15 may include a roof which comprises a pitchback 100. The pitchback 100 is preferably formed of a somewhat elastic material and is mounted by a plurality of springs 102 to the support frame members 26*a*, 26*b*, and 26*c*, and 26*d*. An additional pair of frame members 26*e* and 26*f* lend rigidity to the exercise cell 15 and extend above the pitchback 100 a distance such that a ball hitting the pitchback 100 will not normally cause contact between the pitchback 100 and the frame members 26*e* and 26*f*. The wall 14 also may include a pitchback 104 spring mounted between support frame members 26*a*, 26*b*, 26*c*, and 26*d* and a support frame member 106. Presence of the pitchbacks 100 and 104 causes a ball to rebound with greater velocity than would otherwise be possible.

The lower support frame 24 comprises outer perimeter support lengths 24*a*, 24*b*, 24*c*, and 24*d*, the inner perimeter support lengths 24*e* and 24*f*. The lower support frame 24 resiliently retains the rebound surfaces 12 in the same horizontal plane as the lower support frame 24 by spring means 16 shown generally in FIG. 9 and discussed in detail in reference to FIG. 12 and FIG. 14. Similarly, the upper support frame 26 comprises outer perimeter support lengths 26*a*, 26*b*, 26*c* and 26*d*, and interior cross-sectional support lengths 26*e* and 26*f*.

The eight vertical support groups 28 comprise four corner supports 28*a* and four center supports 28*b*. The vertical support groups provide means for securely supporting the restraining walls 14, and as explained below, the restraining nets 20 and game nets 22. In particular, the center support groups 28*b* cooperate with the restraining nets 20 to effectively prohibit the restraining walls 14 from flexing too far when impacted by a player.

Figure 11:
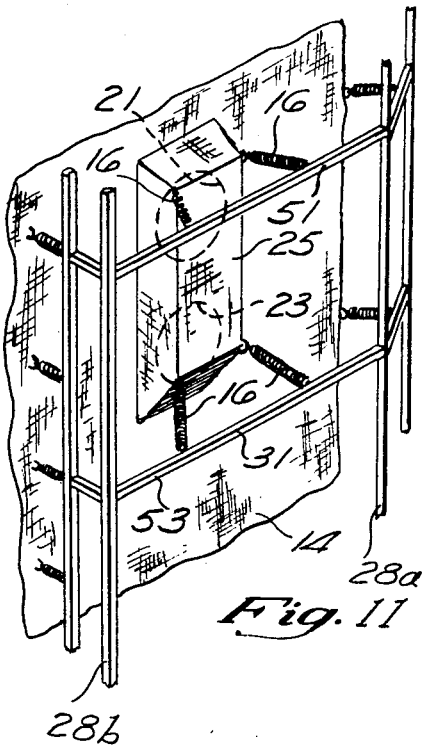
FIG. 11 is a partial perspective view of a wall portion of the exercise structure of FIG. 8, showing means for attaching scoring apertures and a return ramp to the supporting frame.
Figure 10:
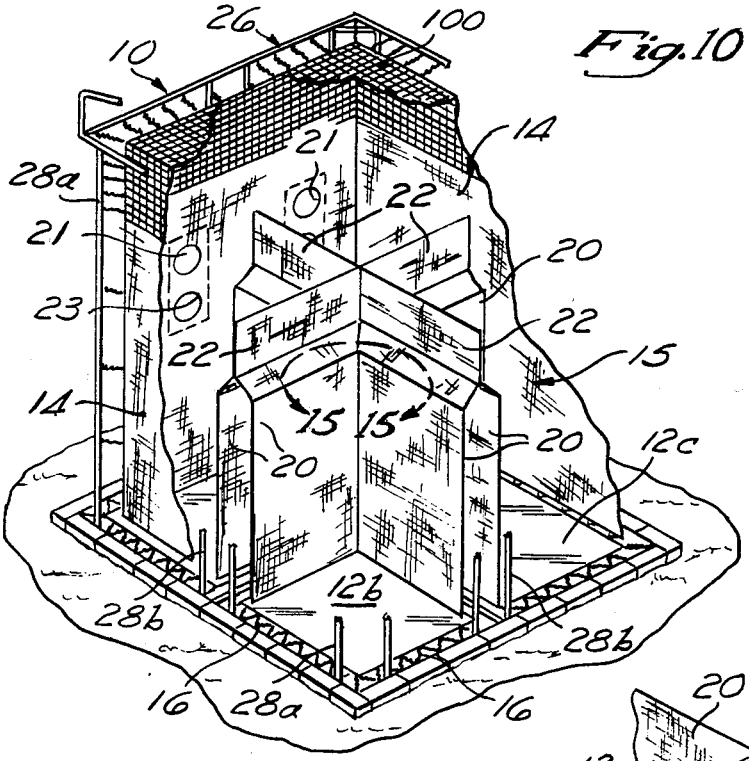
FIG. 10 is a cutaway view of the individual rebound surfaces, restraining nets positioned within the inner perimeter of the rebound surfaces, game nets, and supporting frame of the exercise structure of FIG. 8.

The interior of the exercise cell 15 is shown in FIG. 10. Within the cell 15 are four restraining nets 20, and above them, two smaller vertically adjustable and mutually perpendicular game nets 22. The restraining nets 20 are positioned within the inner perimeter of the rebound surfaces so as to prevent a player from impacting the springs 16 or the interior cross-sectional lengths 26*e* and 26*f* of the lower support frame 26. Referring additionally to FIG. 11, and as explained in reference to the first embodiment, a first aperture 21 and a second aperture 23 are shown through the restraining walls 14. A fabric ramp 25 is coupled to the exterior of the walls 14 over the apertures 21,23. The fabric ramp 25 is coupled at its four corners by springs 16 to cross member supports 51,53 spanning from the center support group 28*b* to the corner support group 28*a*. Each of the quadrants formed by the restraining nets 20 and the restraining walls 14 is provided with the apertures 21,23 and the ramp 25. The restraining nets 20 and game nets 22 are coupled to the restraining walls 14 and to the center support groups 28*b* as described in detail below in reference to FIG. 17 and FIG. 18.

Figure 12:
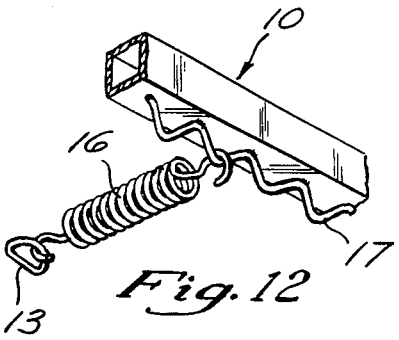
FIG. 12 is an enlarged view of a spring means for coupling selected portions of the restraining and game nets, restraining walls, and rebound surfaces to the supporting frame of the structure of FIG. 8.

Shown in FIG. 12 is a preferred means for coupling the springs 16 to a portion of the supporting frame 10. Each spring 16 is coupled at one end to a D-ring 13. The D-ring 13 is coupled to various portions of the restraining walls 14 restraining nets 20, game nets 22, and the perimeter edges of rebound surfaces 12. The other end of the spring 16 is hooked to a coupling rail 17, which is permanently mounted to the inner face of the various lengths of the support frame 10.

Figure 14:
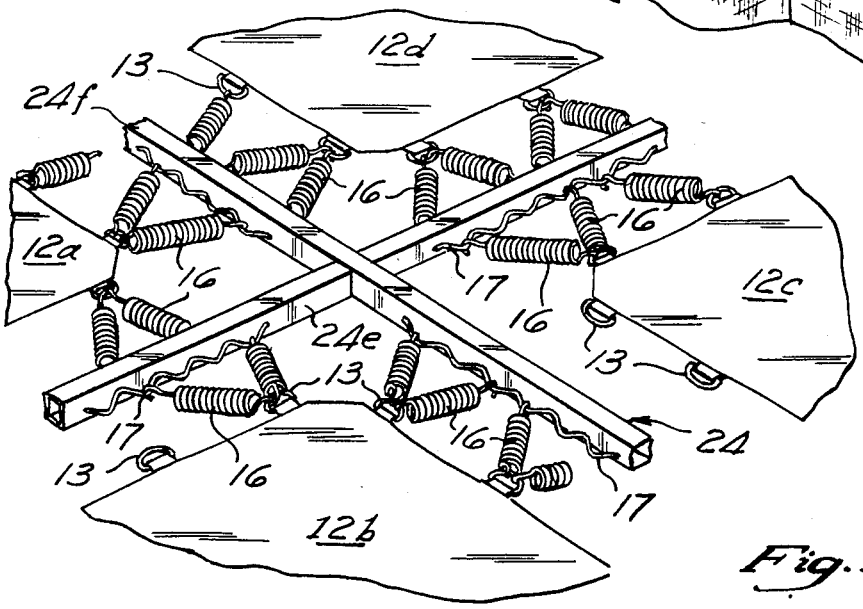
FIG. 14 is an enlarged cutaway view of means for coupling the individual rebound surfaces to the supporting frame, taken along line 14—14 of FIG. 9.

To overcome the need to frequently replace worn springs 16 and to further increase the rebound factor of the rebound surfaces 12, a particular means for fastening the rebound surfaces 12 to the lower support frame 24 is incorporated in the second preferred embodiment and is shown in FIG. 14. A plurality of D-rings 13 are coupled a set distance apart to a perimeter edge of the individual rebound surfaces 12*a*, 12*b*, 12*c* and 13*d*. Each vertical face of the inner perimeter support members 24*e* and 24*f* are fitted with the coupling rails 17. Depending on the size of the players involved in the game, a selected number of the D-rings 13 can be fitted with two springs 16 as opposed to utilizing only one spring 16. Thus, if older and heavier players are involved, or a greater rebound factor is desired, additional springs 16 can be added to further support the rebound surfaces 12. It is important that when springs 16 are added to D-rings 13 along one edge of a rebound surface 12, the same number of springs 16 must be added in to corresponding D-rings 13 along the opposite edge of the same rebound surface 12, thereby assuring proper balancing and even strees distribution along the rebound surface 12 and lower support frame 24.

Greater safety is achieved by utilizing individual rebound surfaces 12 as compared to a single rebound surface as described in the prior art and in the first preferred embodiment shown in FIG. 1. In an exercise structure which incorporates a single rebound surface 12, when numerous players are simultaneously impacting the rebound surface 12, great amounts of stress are put on the springs 16 and support frame 10. In addition when numerous players are impacting the rebound surface 12 at different times, it is impossible to known exactly where any particular player will impact the rebound surface 12. It is possible for a particular player to be expecting contact at a specific instant, but due to the effect on the whole rebound surface 12 of another player's impact, the particular player may unexpectedly impact the rebound surface either an instant earlier or later than originally planned. As a result, it is possible to sustain ankle and knee injuries due to unexpected impact with the rebound surface 12. By providing individual rebound surfaces 12*a*, 12*b*, 12*c* and 12*d*, the impact of one player on rebound surface 12*a*, for example, will have no effect on when the other players will impact rebound surfaces 12*b*, 12*c* or 12*d*. Thus, whereas the first preferred embodiment provides a much greater degree of safety in comparison to known prior art, the second preferred embodiment provides an even greater degree of safety.

Figure 16:
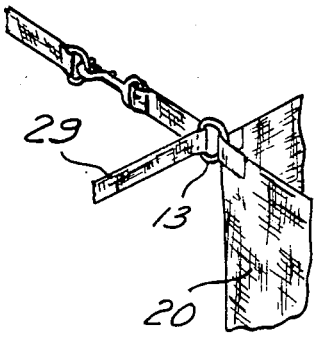
FIG. 16 is an enlarged view of means for interconnecting the restraining nets, taken along line 16—16 of FIG. 15.
Figure 15:
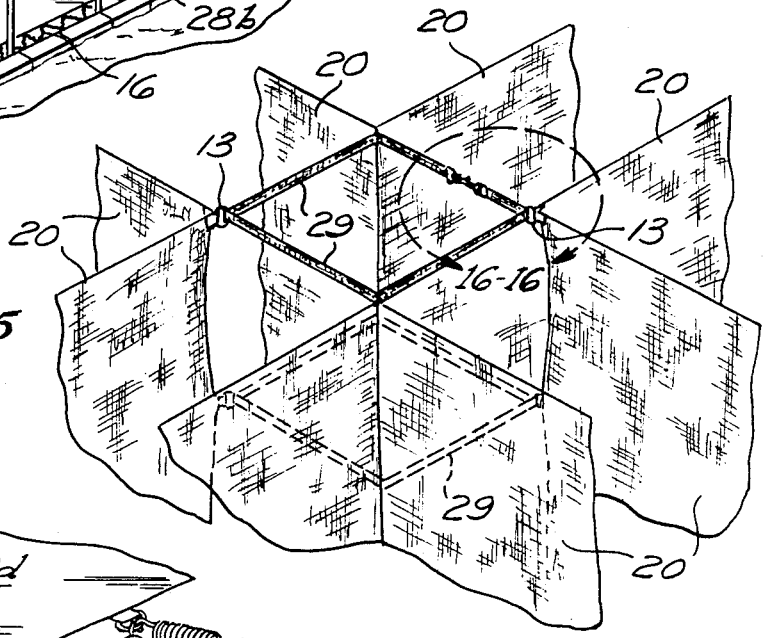
FIG. 15 is an enlarged cutaway view of the restraining and game nets, taken along line 15—15 of FIG. 10.
Figure 17:
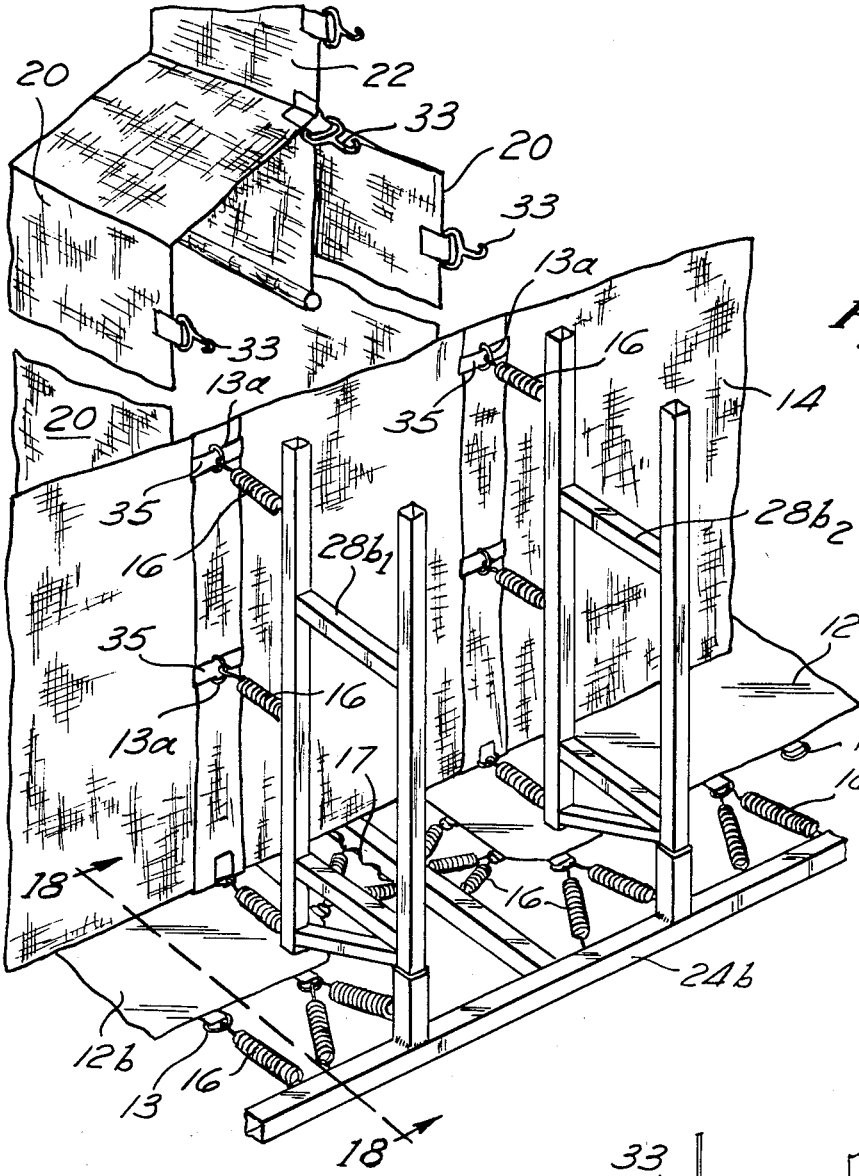
FIG. 17 is an enlarged cutaway view taken along line 17—17 of FIG. 8, showing a portion of the supporting frame and interconnections with the restraining walls and restraining nets.
Figure 18:
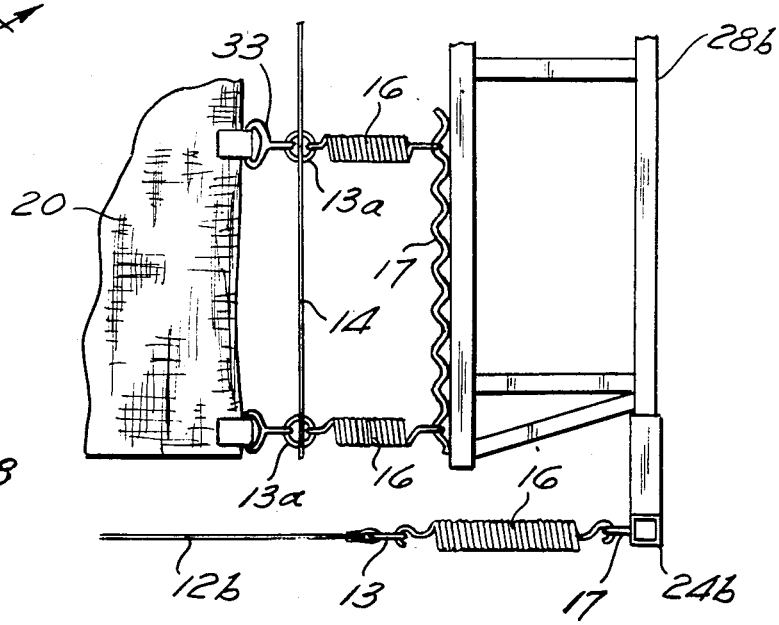
FIG. 18 is an enlarged side view, taken along line 18—18 of FIG. 17, showing means for coupling the rebound surface, restraining wall, and restraining net to a central section of the supporting frame.

As mentioned above, the restraining nets 20 separate the playing cell into four quadrants. Each quadrant corresponds to an individual rebound surface 12*a*, 12*b*, 12*c* or 12*d*. The restraining nets 20 are coupled at the perimeter of the cell 15 to the center support groups 28*b* through the restraining walls 14 as shown in FIG. 17 and FIG. 18 and described below in reference thereto. In addition, each net 20 is fitted with D-rings 13 along a vertically reinforced center as shown in FIG. 15 and FIG. 16. A plurality of tension straps 29 are inserted through corresponding D-rings 13 along the vertical length of each restraining net 20. Each tension strap 29 is then fastened together at its ends to pull the nets 20 taught to form the individual exercise quadrants. Thus, each net is restrained at its ends by the center support groups 28*b* as described below, and at its center by the tension straps 29.

Shown in FIG. 17 and FIG. 18 is means for coupling the restraining nets 20 to the center support groups 28*b* through the restraining walls 14. As shown broadly in FIG. 8, and more particularly in FIG. 17, the center support groups 28*b* comprise a pair of vertical support members 28*b*, and 28$b_2$. Each vertical member 28*b*, 28$b_2$ is aligned along the same vertical plane as the opposing restraining nets 20. The restraining nets 20 are reinforced along the edges to facilitate secure attachment of hooks 33 at set intervals along the edge of the nets 20. At intervals corresponding to those of the hooks 33, and in the same vertical plane as the restraining nets 20 and the corresponding center support 28$b_1$ or 28$b_2$, O-rings 13*a* are inserted through slits in the restraining walls 14. The slits are reinforced with strapping 35 to prevent the O-ring 13*a* from being pulled through the restraining walls 14. As can be seen clearly in FIG. 18, the O-rings 13*a* extend through to both the interior and exterior of the restraining walls 14. Hooks 33 of the restraining nets 20 are coupled to the O-rings 13*a* at the interior of the restraining walls 14. Springs 16 are coupled at one end to the O-rings 13*a* at the exterior of the restraining walls 14, and at the other end to the coupling rails 17 of the center support groups 28*b*.

Since the restraining nets 20 are pulled taught at the center of the exercise cell 15 by tension straps 29, coupling the nets 20 to the O-rings 13*a* of the restraining walls 14 serves to prevent the center portion of the walls 14 from flexing outward at such a great degree as to be ineffective for restraining a player who has impacted the wall 14. Further, coupling the O-rings 13*a* of the walls 14 to the center support groups 28*b* provides the tension necessary to prevent the restraining nets 20 from flexing too great of an amount to be effective for restraining a player who has impacted the net 20.

Referring again to FIG. 18, it is readily apparent that, as in the above-described first preferred embodiment, the restraining walls 14 are positioned well within the perimeter of the edge of the rebound surfaces 12, thereby assuring that a player cannot impact or become entangled in the support frame 10 or springs 16.

Figure 19:
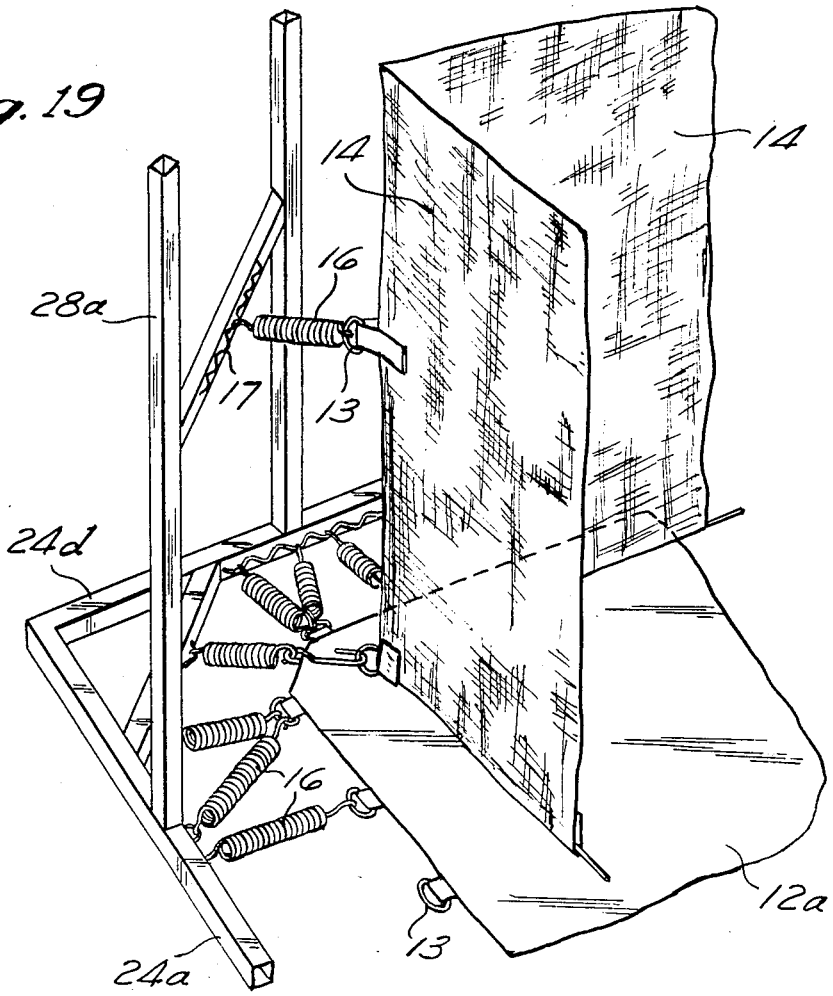
FIG. 19 is an enlarged view, taken along lines 19—19 of FIG. 8, showing means for coupling the rebound surface restraining wall, and restraining net is a corner section of the supporting frame.

Referring to FIG. 19, the corner vertical support group 28*a* is shown providing the required support for the corners of the restraining walls 14. The walls 14 are reinforced along the vertical length of the center to facilitate secure fastening of D-rings 13 to the walls 14. Springs 16 are coupled at one end to the D-rings 13, and at the other end to the corner support groups 28*a* to securely hold the restraining walls 14. Thus, each quadrant of the cell 15 is bounded by the restraining nets 20 at the interior and by the restraining walls 14 at the exterior.

Thus, a tension equilibrium is achieved between the restraining nets 20 and the restraining walls 14, caused by the tension straps 29 and the spring 16 coupled to the center support groups 28. The effect is to prevent a flexible restraining wall or net of substantial horizontal length from flexing upon impact around the midpoint of the length.

The exercise cell 15 which has been described in reference to the second preferred embodiment, is not only safe and suitable for exercise, but also is suitable for playing the inventive ball game described above in reference to the first preferred embodiment of FIG. 1.

It is noted that one could easily adapt the exercise cell of FIG. 8 to provide only two opposing exercise halves instead of quadrants. In such a configuration, only two rebound surfaces 12 would be employed instead of four as shown in FIG. 9. In addition, only two restraining nets 20 would be required.

Further, one could provide a single rectangular rebound surface 12 with the restraining walls 14 and a single restraining net 20 and game net 22 as disclosed in the second preferred embodiment. In such a manner, the restraining walls 14 could effectively be prevented from flexing at too great a degree proximate the restraining nets 20.

FIGS. 20, 21, and 22 show an alternative embodiment of the invention. In FIG. 20, the device is shown to include a rebound surface 63 which forms the upper surface of an air-filled mattress 64. The rebound surface 63 has a rebound factor of at least 20% and preferably at least 30%. The mattress 64, including rebound surface 63, is formed of air-tight material, such as rubberized nylon fabric. The sidewalls 65 of the mattress 64 are tucked inwardly by a resilient cord or spring 66 which is placed approximately midway along the height of said sidewalls 65 and has a relaxed diameter which is smaller than the normal inflated diameter of said mattress 64. The mattress 64 is sized to provide an upper rebound surface 63 approximately the same size as surface 12 of the preferred embodiment.

The interaction of the spring 66 and the mattress 64 produces lower and upper bulges 68 and 70 in the sidewalls 65. The mattress 64 is filled with air maintained under pressure by a fan 72. The precise structure and operation of such a fan is well known to those of ordinary skill in the art and is shown in U.S. Pat. No. 4,068,739, hereby incorporated by reference herein. Attached to the perimeter of the rebound surface 63 and within the outer edge of the mattress 64 is a larger enclosure 74 which is formed from a flexible air-tight fabric material and filled with air maintained under pressure by a fan 76. The pressure of the air within the enclosure 74 is less than the pressure of the air in mattress 64. The enclosure 74 thus creates a large, balloon-like cell supported vertically by the air pressure within which stretches the fabric walls taut. The cell 77 can be entered through an opening, such as through a zipper 78, which is rapidly re-closed to maintain air pressure within cell 77. Within the enclosure 74 are located the restraining and game nets 20 and 22, typically strung from the taut walls of enclosure 74. The interior of the exercise and game cell in FIG. 8 is thus quite similar to that described above for the other preferred embodiment.

Another aspect of this preferred embodiment is shown in FIG. 21. The mattress 64 contains a plurality of partitions 80 formed of netting to permit free air flow within the mattress 64. The netting partitions 80 may have many different configurations within the mattress 64. However, as shown, they extend laterally from one side of the mattress to the other and are generally radially oriented, separated by 45°. The upper and lower edges of the partitions 80 are attached, as by sewing, to the underside of rebound surface 63 and the top of bottom surface 79, respectively, of the mattress 64. The partitions 80 are not connected to the mattress at their sides.

The function of the partitions 80 can be understood with reference to FIGS. 22 and 23. The schematic of FIG. 22 shows the air mattress 64 at equilibrium. In this configuration, partitions 80 maintain the surfaces 63 and 79 mutually parallel and flat, prohibiting the air pressure within the mattress 64 from bulging these surfaces. FIG. 23 shows the mattress 64 when a portion of it has been depressed, such as by a person jumping on the rebound surface 63. The depression 81 of the rebound surface 63 has a natural tendency to bulge the sides 65 of the mattress 64 outward and also to bulge the rebound surface 63 upward. The natural upward tendency of the rebound surface 63 in reaction to the depression 81 is not desirable because it would tend to affect the user of the device, perhaps causing him to lose his balance. The partitions 80, however, which are connected internally to the top 63 and bottom 79 of the mattress 64 prevent the rebound surface from expanding upward in reaction to a depression on its surface is limited to bulging at sides 65 of the mattress 64 outward, as is shown in FIG. 23. Since this bulging is accompanied by a resilient stretching of the spring or cord 66, the mattress 64 provides a highly resilient jumping surface 63 for the user.

As with the preferred embodiment, the embodiment of FIGS. 20–22 may be used for the described net game, and protects, using the cell 77, players from injury.

I claim:

1. An apparatus for use by one or more persons as an exercise game or device, comprising:

a plurality of adjacent and flexible rebound surfaces upon which a person may jump;

a flexible outer wall around said rebound surfaces to form an enclosure, said outer wall being positioned within the perimeter of the rebound surfaces to deflect a person jumping on one of the rebound surfaces and to protect the person from being injured;

flexible dividers for dividing the enclosure into compartments corresponding to the plural rebound surfaces, the dividers being positioned within the perimeter of each of the rebound surfaces to deflect a person jumping on one of the rebound surfaces and to protect the person from being injured;

a support structure, external to said outer wall;

resilient couplings connecting said dividers and said external support structure to retain said dividers under tension, wherein said outer wall is attached to said resilient couplings that connect said dividers and said external support structure to reduce the amount said wall can flex upon impact by the person jumping on the rebound surface.

2. An apparatus for use by one or more persons as an exercise game or device, comprising:

a plurality of adjacent and flexible rebound surfaces upon which a person may jump;

a support for said rebound surfaces;

resilient couplings attaching the rebound surfaces to the support;

a flexible outer wall around said rebound surface to form an enclosure, said outer wall being positioned within the perimeter of the rebound surfaces to deflect a person jumping on one of the rebound surfaces and to protect the person from being injured by (i) falling from the rebound surfaces, (ii) impacting the resilient couplings or (iii) impacting the support;

flexible dividers for dividing the enclosure into compartments corresponding to the plural rebound surfaces, said dividers comprising at least one pair of flexible walls spaced apart from one another, the flexible divider wall being positioned within the perimeter of each of the rebound surfaces to deflect a person jumping on one of the rebound surfaces and to protect the person from being injured by (i) entering an adjacent section, (ii) impacting the resilient couplings, or (iii) impacting the support means.

3. An apparatus as claimed in claim 2, wherein said flexible divider walls are separated at the center of the enclosure and held there by resilient connectors to maintain the separated flexible divider walls taut.

4. An apparatus as claimed in claim 2, having game netting above and in alignment with at least one of said flexible divider walls so that a ball can be passed over said netting from one compartment to another.

5. An apparatus as claimed in claim 2, wherein said flexible divider walls intersect said outer wall at substantially right angles.

* * * * *